US007585407B2

(12) United States Patent
Duyvesteyn et al.

(10) Patent No.: US 7,585,407 B2
(45) Date of Patent: Sep. 8, 2009

(54) PROCESSING ASPHALTENE-CONTAINING TAILINGS

(75) Inventors: Willem P. C. Duyvesteyn, Reno, NV (US); Julian Kift, Reno, NV (US); Raymond L. Morley, Sparks, NV (US)

(73) Assignee: Marathon Oil Canada Corporation, Calgary, Alberta (CA)

( * ) Notice: Subject to any disclaimer, the term of this patent is extended or adjusted under 35 U.S.C. 154(b) by 646 days.

(21) Appl. No.: 11/371,327

(22) Filed: Mar. 7, 2006

(65) Prior Publication Data

US 2007/0209971 A1 Sep. 13, 2007

(51) Int. Cl.
*C10G 1/04* (2006.01)
*C10G 1/00* (2006.01)

(52) U.S. Cl. ..... 208/390; 208/6; 208/391; 208/425; 208/426; 209/164; 209/166

(58) Field of Classification Search ..... 208/6, 208/44, 390, 391, 425, 426; 209/12.1, 164, 209/168

See application file for complete search history.

(56) References Cited

U.S. PATENT DOCUMENTS

| | | | | |
|---|---|---|---|---|
| 2,871,180 A | | 1/1959 | Lowman et al. | |
| 3,779,902 A | * | 12/1973 | Mitchell et al. | 208/251 R |
| 4,035,282 A | | 7/1977 | Stuchberry et al. | |
| 4,046,668 A | | 9/1977 | Farcasiu et al. | |
| 4,120,773 A | | 10/1978 | Ridgway | |
| 4,120,777 A | | 10/1978 | Globus | |
| 4,308,133 A | | 12/1981 | Meyer | |
| 4,347,118 A | | 8/1982 | Funk et al. | |
| 4,490,259 A | | 12/1984 | Coffing | |
| 4,589,980 A | | 5/1986 | Keys | |
| 4,612,113 A | | 9/1986 | Kallioinen | |

(Continued)

FOREIGN PATENT DOCUMENTS

| | | |
|---|---|---|
| WO | WO 01/32936 | 5/2001 |
| WO | WO 03/072506 | 9/2003 |

OTHER PUBLICATIONS

International Search Report from International Application No. PCT/US2006/08263.

Hong and Chao, "A Polar-Nonpolar, Acetic Acid/Heptane, Solvent Medium for Degradation of Pyrene by Ozone," *Ind. Eng. Chem. Res.* 43:7710-7715 (2004).

*Primary Examiner*—Walter D Griffin
*Assistant Examiner*—Jerrod B Marten
(74) *Attorney, Agent, or Firm*—Holland & Hart LLP

(57) ABSTRACT

Embodiments of a method and a system for recovering energy, materials or both from asphaltene-containing tailings are disclosed. The asphaltene-containing tailings can be generated, for example, from a process for recovering hydrocarbons from oil sand. Embodiments of the method can include a flotation separation and a hydrophobic agglomeration separation. Flotation can be used to separate the asphaltene-containing tailings into an asphaltene-rich froth and an asphaltene-depleted aqueous phase. The asphaltene-rich froth, or an asphaltene-rich slurry formed from the asphaltene-rich froth, then can be separated into a heavy mineral concentrate and a light tailings. Hydrophobic agglomeration can be used to recover an asphaltene concentrate from the light tailings. Another flotation separation can be included to remove sulfur-containing minerals from the heavy mineral concentrate. Oxygen-containing minerals also can be recovered from the heavy mineral concentrate. Water removed by the various separation steps can be recycled and its heat energy recovered.

30 Claims, 2 Drawing Sheets

U.S. PATENT DOCUMENTS 4,678,561 A 7/1987 Keys
4,678,562 A 7/1987 Keys
4,744,890 A 5/1988 Miller et al.
4,859,317 A 8/1989 Shelfantook et al.
4,888,108 A * 12/1989 Farnand ..... 208/424
5,143,598 A 9/1992 Graham et al.
5,176,802 A 1/1993 Duyvesteyn et al.
5,223,148 A 6/1993 Tipman et al.
5,236,577 A 8/1993 Tipman et al.
5,389,274 A 2/1995 Fernandez
5,443,158 A 8/1995 McKenny et al.
5,485,883 A 1/1996 Rippetoe et al.
5,538,081 A 7/1996 Rippetoe et al.
5,554,301 A 9/1996 Rippetoe et al.
5,626,743 A 5/1997 Humphreys
5,626,793 A 5/1997 Reiffenrath et al.
5,670,056 A 9/1997 Yoon et al.
5,702,612 A 12/1997 Wang
5,795,466 A 8/1998 Kelebek et al.
5,849,201 A 12/1998 Bradley
5,876,592 A 3/1999 Tipman et al.
5,961,786 A 10/1999 Freel et al.
5,968,349 A 10/1999 Duyvesteyn et al.
6,007,709 A 12/1999 Duyvesteyn et al.
6,036,849 A 3/2000 Rippetoe et al.
6,074,558 A 6/2000 Duyvesteyn et al.
6,106,787 A 8/2000 Rippetoe
6,214,213 B1 4/2001 Tipman et al.
6,320,148 B1 11/2001 Yoon et al.
6,427,843 B1 8/2002 Clark
6,589,417 B2 7/2003 Taciuk et al.
6,793,079 B2 9/2004 Khan et al.
6,871,743 B2 3/2005 Yoon et al.
2005/0150844 A1 * 7/2005 Hyndman et al. ..... 210/750

* cited by examiner

PROCESSING ASPHALTENE-CONTAINING TAILINGS

FIELD

This disclosure relates to the recovery of energy, materials or both from asphaltene-containing tailings, such as asphaltene-containing tailings generated during oil sand processing.

BACKGROUND

Asphaltenes are high molecular weight hydrocarbons having a chemical structure that can include stacks of condensed aromatic rings. Due to their high molecular weight, asphaltenes can be found within the least volatile fraction after distillation of crude oil. Asphaltenes also can be found in oil sand along with minerals and other hydrocarbons. Among the other hydrocarbons, oil sand can include lignite and other low-rank coal phases.

Oil sand can be processed to recover hydrocarbons for upgrading into more valuable products, such as oil. Asphaltenes, however, do not behave in the same manner as other hydrocarbons in oil sand, so the same processes typically cannot be used to upgrade them. Thus, in certain conventional processes for recovering hydrocarbons from oil sand, the asphaltenes most often are separated along with the minerals, lignite and water into a tailings stream. Without further processing, the asphaltene-containing tailings can be damaging to the environment. Disposal of the asphaltene-containing tailings also can waste potentially valuable energy and materials.

SUMMARY

Disclosed herein are embodiments of a method and a system for recovering energy, materials or both from asphaltene-containing tailings, such as asphaltene-containing tailings from a process for recovering hydrocarbons from oil sand. Embodiments of the method can include a flotation separation and a hydrophobic agglomeration separation. In some embodiments, coarse materials are separated from the asphaltene-containing tailings prior to further processing. This can be accomplished, for example, by subjecting the asphaltene-containing tailings to a cyclone separation, such as a gas-sparged hydrocyclone separation. The coarse materials can be removed with an underflow from the cyclone separation.

The flotation separation can include, for example, introducing gas into the asphaltene-containing tailings such that asphaltenes in the asphaltene-containing tailings rise with bubbles of the gas to form an asphaltene-rich froth over an asphaltene-depleted aqueous phase. The asphaltene-rich froth can include water, asphaltenes, any remaining solvent from previous processing and any naturally floatable or flotation activated mineral species, including lignite. The asphaltene-depleted aqueous phase can include water and non-floatable minerals. After the flotation separation, a thickening process can be used to convert the asphaltene-rich froth into an asphaltene-rich slurry. In some embodiments, heat energy is recovered from water removed from the asphaltene-rich froth or the asphaltene-rich slurry. Water and the contained heat energy also can be recovered from the asphaltene-depleted aqueous phase.

The asphaltene-rich froth or asphaltene-rich slurry can be separated into a heavy mineral concentrate and a light tailings, such as by a gravity separation process. The heavy mineral concentrate can include minerals targeted for recovery. These minerals can include, for example, oxygen-containing minerals, such as Group 4B metal oxides, particularly titania, zirconia, iron oxide-titania minerals (e.g., ilmenite), and combinations thereof. The heavy mineral concentrate also can include minerals to be excluded from waste generated by the overall process, such as sulfur-containing minerals (e.g., pyrite, marcasite, base metal sulfides, etc.). The light tailings can include water, asphaltenes, lignite and solvent. In some embodiments, a coarse lignite phase also is separated from the asphaltene-rich froth or asphaltene-rich slurry. This separation can be accomplished, for example, by physical processing using a size separation such as screening, by a gravity separation such as a hydrocyclone or by solvent extraction to partially or fully dissolve the asphaltenes, leaving the non-soluble coal and lignite hydrocarbons or by any combination thereof.

A hydrophobic agglomeration separation can be performed on the light tailings. This separation can include, for example, dispersing a hydrophobic agglomeration agent within the light tailings to form droplets. The droplets can agglomerate with the asphaltenes to form asphaltene-containing particles, which can be separated as an asphaltene concentrate. In some embodiments, the asphaltene-containing particles are separated by gravity separation, filtration or both. The hydrophobic agglomeration agent can comprise diesel, a fuel oil, a surfactant, or a combination or derivative thereof. Dispersants and modifiers also can be added. Some embodiments include shear mixing or ultrasonic attrition prior to hydrophobic agglomeration. In addition, some embodiments include introducing an oxidizing agent, a causticizing agent, both or a mixture thereof into the light tailings before or while dispersing the hydrophobic agglomeration agent. Furthermore, some embodiments include separating the asphaltenes from one or more lignite phases.

In some disclosed embodiments, solvent is recovered with the asphaltene concentrate. In oil sand processing, this can be useful to reduce the need for near complete solvent recovery after separation of asphaltenes from other hydrocarbons. For example, some embodiments of the disclosed method include providing a bitumen froth comprising bitumen, asphaltenes, inorganic solids and water. For example, the bitumen froth can comprise between about 20% and about 80% bitumen, between about 10% and about 75% water, between about 5% and about 45% inorganic solids and between about 1% and about 25% asphaltenes. This bitumen froth then can be mixed with a paraffinic hydrocarbon solvent to form a mixture. The paraffinic hydrocarbon solvent can have a chain length between about 5 and about 8 carbons. In some embodiments, the paraffinic hydrocarbon solvent comprises about 50% by weight pentane and about 50% by weight hexane. Adding the paraffinic hydrocarbon solvent causes precipitation of the asphaltenes. The resulting mixture then can be separated into a dilute bitumen product and a residue, with the dilute bitumen product comprising bitumen and paraffinic hydrocarbon solvent and having a lower concentration of precipitated asphaltenes, inorganic solids and water than the mixture. Next, between greater than 0% and about 95% of the remaining paraffinic hydrocarbon solvent present in the residue can be recovered in a solvent recovery unit. The solvent recovery unit can produce a tailings stream comprising water, inorganic solids, precipitated asphaltenes and non-recovered paraffinic hydrocarbon solvent. The precipitated asphaltenes and the non-recovered paraffinic hydrocarbon solvent then can be separated from the tailings stream, such as by flotation, gravity separation, hydrophobic agglomeration, or a combination thereof. Since the tailings stream that exits the solvent recovery unit is subjected to further processing, the solvent recovery process used within the solvent recovery unit can be less complete and less expensive than stream stripping. For example, flotation using an inert gas phase, gravity separation, vacuum stripping, or a combination thereof, can be used as the solvent recovery process in the solvent recovery unit. In some embodiments, the tailings stream exits the solvent recovery unit at a temperature between about 20° C. and about 65° C.

Some disclosed embodiments include separating sulfur-containing minerals from the heavy mineral concentrate. This separation can include, for example, attritioning the heavy mineral concentrate to disagglomerate, scrub or clean the sulfur-containing minerals' surfaces. Similar to the separation of asphaltenes, the separation of sulfur-containing minerals can be achieved by flotation. Gas bubbles can be introduced into the heavy mineral concentrate such that the sulfur-containing minerals rise with the gas bubbles to form a sulfur-rich froth over a sulfur-depleted aqueous phase. Thereafter, the sulfur-containing minerals can be recovered from the sulfur-rich froth, or a sulfur-rich slurry formed from the sulfur-rich froth, and oxygen-containing minerals, such as titania, zirconia, ilmenite, gangue minerals (e.g., garnet and staurolite), and combinations thereof, can be recovered from the sulfur-depleted aqueous phase.

A variety of reagents can be used to facilitate the separations included in embodiments of the disclosed method. For example, frother and collector reagents can be used with each flotation separation. These reagents can be introduced prior to the introduction of gas bubbles. In the flotation separation performed on the asphaltene-containing tailings, the frother reagent can comprise an aliphatic alcohol, a cyclic alcohol, a phenol, an alkoxy paraffin, a polyglycol, or a combination or derivative thereof. The collector reagent used with this separation can comprise a fuel oil, sodium oleate, a fatty acid, a xanthate, an alkyl sulfuric salt, a dithiophosphate, an amine, or a combination or derivative thereof. In the flotation separation performed on the heavy mineral concentrate, the frother reagent can comprise an aliphatic alcohol, a cyclic alcohol, a phenol, an alkoxy paraffin, a polyglycol, or a combination or derivative thereof. The collector reagent used with this separation can comprise a fuel oil, sodium oleate, a fatty acid, a xanthate, an alkyl sulfuric salt, a dithiophosphate, an amine, or a combination or derivative thereof. Reagents also can be used in conjunction with the separation of the asphaltene-rich froth or the asphaltene-rich slurry into the heavy mineral concentrate and the light tailings. These reagents can comprise, for example, a dispersant, a modifier, a surfactant, or a combination or derivative thereof. In some embodiments, the dispersant comprises a silicate, a phosphate, a citrate, a lignin sulfonate, or a combination or derivative thereof.

Embodiments of the disclosed system can include a flotation apparatus for separating the asphaltene-containing tailings into the asphaltene-rich froth and the asphaltene-depleted aqueous phase, a gravity separation apparatus for separating the asphaltene-rich froth, or the asphaltene-rich slurry formed from the asphaltene-rich froth, into the heavy mineral concentrate and the light tailings, and a hydrophobic agglomeration mixing apparatus for dispersing the hydrophobic agglomeration agent within the light tailings. These and other embodiments also can include a hydrophobic agglomeration settling apparatus for separating the asphaltene concentrate from the light tailings. To separate coarse materials from the asphaltene-containing tailings before the asphaltene-containing tailings enter the flotation apparatus, some embodiments also include a cyclone separation apparatus.

In addition to a flotation apparatus configured to receive the asphaltene-containing tailings, some embodiments of the disclosed system include a flotation apparatus configured to separate the heavy mineral concentrate into the sulfur-rich froth and the sulfur-depleted aqueous phase, which can, for example, contain gangue minerals such as garnet and staurolite. One or both of the separation apparatuses can be associated with a thickening apparatus. For example, the flotation apparatus that receives the asphaltene-containing tailings can be connected to a thickening apparatus configured to thicken the asphaltene-rich froth to form the asphaltene-rich slurry.

Many of the devices used in embodiments of the disclosed system separate water from other materials. Some embodiments include one or more conduits for recycling this water. For example, some embodiments include a conduit for recycling water that exits one or more of the flotation apparatuses.

DETAILED DESCRIPTION

Figure 1:
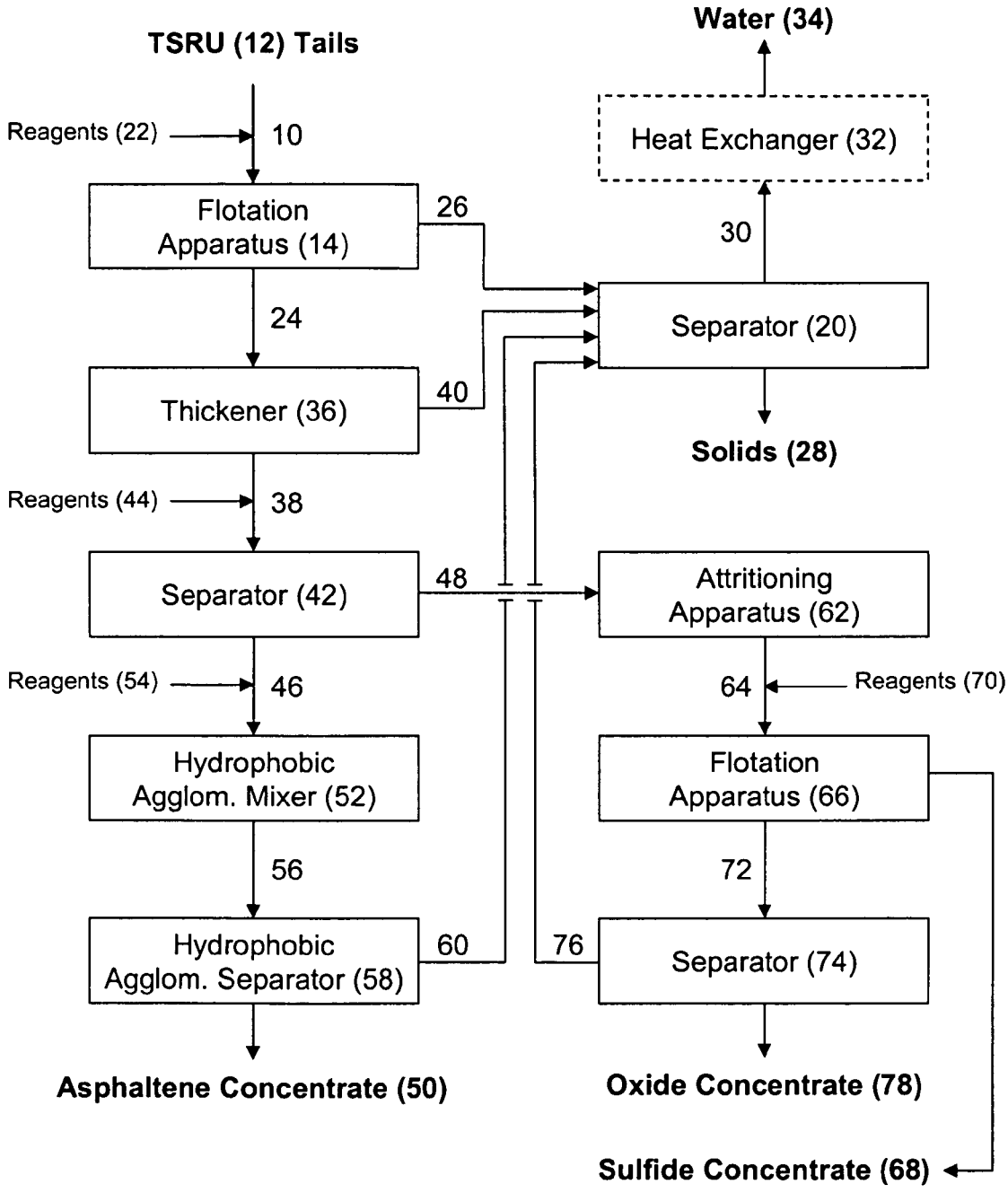
FIG. 1 is a schematic diagram representing embodiments of a method and a system for recovering energy, materials or both from asphaltene-containing tailings.

Unless otherwise explained, all technical and scientific terms used herein have the same meaning as commonly understood by one of ordinary skill in the art to which this disclosure belongs. The singular terms "a," "an," and "the" include plural referents unless the context clearly indicates otherwise. Similarly, the word "or" is intended to include "and" unless the context clearly indicates otherwise. The term "includes" means "comprises." The method steps described herein, such as the separation steps and the mixing steps, can be partial, substantial or complete unless indicated otherwise. All percentages recited herein are dry weight percentages unless indicated otherwise.

As used herein, the term "heavy minerals" refers to minerals having a greater molecular weight than other minerals in a given stream or batch.

As used herein, the term "lignite" refers to all low-rank coal that may be present in oil sand, including lignite and subbituminous coal. This coal may, for example, have a moisture content greater than about 20%.

As used herein, the term "coarse materials" refers to material particles having a greater size than other material particles in a given stream or batch, such as a size sufficient to allow the coarse materials to be separated in an underflow exiting a cyclone separation process.

Disclosed herein are embodiments of a method and a system for recovering energy and/or materials from asphaltene-containing tailings. Asphaltene-containing tailings often are generated as a byproduct of oil sand processing. One example of oil sand processing can be found in U.S. Pat. No. 6,007,709, which is incorporated herein by reference. Oil sand processing can include a flotation separation resulting in the formation of a froth comprising hydrocarbons, certain minerals and entrained sand. For example, the froth can include about 60% bitumen, about 25% water, about 10% inorganic solids and about 8% asphaltenes. Typical ranges for the concentration of bitumen in the froth are between about 20% and about 80% and between about 40% and about 70%. Typical ranges for the concentration of water in the froth are between about 10% and about 75% and between about 15% and about 40%. Typical ranges for the concentration of inorganic solids in the froth are between about 5% and about 45% and between about 5% and about 20%. Typical ranges for the concentration of asphaltenes in the froth are between about 1% and about 25% and between about 5% and about 15%.

To separate the asphaltenes from the hydrocarbons targeted for recovery, the froth can be mixed with a solvent and subjected to one or more settling stages. The solvent can be, for example, a paraffinic hydrocarbon solvent, such as a paraffinic hydrocarbon solvent having a chain length between about 5 and about 8 carbons. In a specific example, the solvent comprises about 50% by weight pentane and about 50% by weight hexane. The solvent used to precipitate the asphaltenes typically is toxic and would be harmful to the environment if included in a waste stream. Therefore, the solvent often is separated from the other waste materials and recycled. Separation of the solvent can occur, for example, in a tailings solvent recovery unit (TSRU). Conventionally, the tailings that exit the TSRU are disposed of as a waste product.

The disclosed method and system can be used to recover additional value from asphaltene-containing tailings, such as asphaltene-containing tailings that exit a TSRU within a process for recovering hydrocarbons from oil sand. This value can result, for example, from the recovery of energy and/or materials, such as asphaltenes, sulfur-containing minerals, oxygen-containing minerals and any solvent not removed in the TSRU. The recovered asphaltenes can be at least partially upgraded into useful oil, such as by the Taciuk kiln process (as shown, for example, in U.S. Pat. No. 6,589,417, which is incorporated herein by reference) or by non-Taciuk pyrolysis (as shown, for example, in U.S. Patent No. 5,961,786, which is incorporated herein by reference). Valuable minerals that can be recovered from asphaltene-containing tailings include, for example, oxygen-containing minerals, such as Group 4B metal oxides, particularly titania, zirconia, iron oxide-titania minerals (e.g., ilmenite) and combinations thereof. In addition to recovering energy and/or materials, the disclosed method and system have the potential to reduce the adverse environmental consequences associated with direct disposal of asphaltene-containing tailings.

The disclosed method and system also can reduce costs associated with solvent removal in the TSRU. Conventionally, steam stripping is used to remove the solvent. Steam stripping does not always result in a near complete separation of the solvent and it can be expensive due to the energy demands. Steam is required not only for stripping the volatile organic phase, but also for preheating the TSRU tailings and the stripping medium. Incorporating a separation process downstream from the TSRU has the potential to significantly reduce the need for a near complete separation of the solvent in the TSRU. For example, in embodiments of the disclosed method, the tailings that exit the TSRU may contain some solvent. This solvent can be removed with the asphaltenes by the various separations, such as flotation and/or hydrophobic agglomeration separations. By eliminating the need for a near complete separation of the solvent in the TSRU, it is possible to use a less expensive solvent recovery process in the TSRU, such as vacuum stripping or column flotation under an inert gas (such as nitrogen) blanket. These processes can result in a solvent recovery, for example, between greater than 0% and 99.9%, such as between greater than 0% and about 99% or between greater than 0% and about 95%. In comparison to steam stripping, these processes typically require significantly less heat and can be carried out at ambient temperatures. For example, the tailings that exit the TSRU can have a temperature between about 20° C. and about 85° C., such as between about 20° C. and about 65° C. or between about 20° C. and about 55° C.

Several different types of separations can be used in embodiments of the disclosed method, including cyclone separation (e.g., gas-sparged hydrocyclone separation), flotation separation, gravity separation, hydrophobic agglomeration separation, and combinations thereof. In some implementations, the separations are customized to the special characteristics of the asphaltene-containing tailings being processed. The separations also can be customized to the processing scheme. For example, the separations can be modified to accommodate continuous, batch or semi-batch processing.

Cyclone separation can be used, for example, to remove coarse material from the asphaltene-containing tailings prior to further processing. Separating coarse materials at this stage may facilitate improved operation of downstream equipment. Cyclone separation can include inducing or facilitating spinning of the asphaltene-containing tailings in a conical vessel. The resulting centrifugal force causes some materials suspended in the tailings to collect in an underflow. When performed on TSRU tailings from a process for the recovery of hydrocarbons from oil sand, the underflow exiting the cyclone separator is likely to include coarse minerals and heavy minerals and some water. The coarse minerals can be separated from the water, for example, by gravity settling. The water then can be recycled back into the process. The overflow can be routed to a holding tank for further processing.

Like other cyclone separation processes, gas-sparged hydrocyclone separation typically includes the application of centrifugal force. Gas-sparged hydrocyclone separation, however, also includes introducing fine gas bubbles into the asphaltene-containing tailings while centrifugal force is being applied. For example, the bubbles can be introduced through fine holes in the walls of a conical vessel in which the asphaltene-containing tailings are spun. Introducing these bubbles further promotes separation by the flotation principles discussed below. The gas can be, for example, air or another inert gas.

As mentioned above, flotation often is used in processes for recovering hydrocarbons from oil sand. Flotation also can be used to separate asphaltenes and certain target minerals from other materials in asphaltene-containing tailings. The target minerals can include valuable minerals, such as titania, ilmenite and zirconia, as well as minerals that may be harmful to the environment, such as sulfur-containing minerals. Flotation can be conducted over one or more than one separate stages. For example, some embodiments include a rougher stage to effect an initial or rough separation targeting high recovery, a scavenger stage to scavenge any remaining asphaltenes or target minerals and a cleaner stage to clean any one of the rougher or scavenger stage products of asphaltene or target minerals to higher purity. Each successive stage can be configured and optimized to the recovery of diminishing concentrations of asphaltenes and target minerals. Recirculation, recycle or re-treatment of some streams and products also can be included.

In some disclosed embodiments, separation by flotation includes introducing gas, such as air or nitrogen, into the asphaltene-containing tailings. Reagents also can be introduced, as discussed, to achieve one or more desired results. These reagents can include, for example, frother reagents. Some embodiments include the use of a frother reagent selected to promote the formation of stable bubbles, such as stable bubbles that attract asphaltenes and/or the target minerals. Useful frother reagents include, for example, aliphatic alcohols, cyclic alcohols, phenols, alkoxy paraffins, polyglycols and combinations and derivatives thereof. In some embodiments, the frother reagents have a polar group, such as a hydroxyl polar group, a carboxyl polar group, a carbonyl polar group, an amino polar group, a sulfo polar group, or a combination thereof. The frother reagents can be introduced at a concentration selected to promote the formation of stable bubbles, such as stable bubbles that attract asphaltenes and/or the target minerals. For example, the frother reagents can be introduced at a concentration between about 5 ppm and about 100 ppm, such as between about 15 ppm and about 35 ppm.

Some embodiments also include the use of collector reagents selected to increase the hydrophobicity (i.e., the contact angle) of the asphaltenes and/or the target minerals. Useful collector reagents include fuel oils, sodium oleate, fatty acids, xanthates, alkyl sulfuric salts, dithiophosphates, amines and combinations and derivatives thereof. The collector reagents can be anionic or cationic. The collector reagents can be introduced at a concentration selected to increase the hydrophobicity of the asphaltenes and/or the target minerals. For example, the collector reagents can be introduced at a concentration between about 5 ppm and about 500 ppm, such as between about 25 ppm and about 50 ppm.

In addition to frother reagents and collector reagents, some embodiments include the use of modifiers, such as depressants, dispersants, regulators, and activators. Depressants can be used, for example, to surface coat certain minerals to prevent hydrophobicity and floating of these minerals. Depressants can be used in conjunction with collector reagents to selectively float target minerals. This process can be used, for example, to separate particles within the asphaltene-containing tailings. Regulators can be used, for example, to control the pH of the asphaltene-containing tailings. Activators can be used, for example, to promote interaction between the collector reagent and the asphaltenes and/or the target minerals.

During flotation, the asphaltenes and the target minerals attach to and rise with the gas bubbles to form an asphaltene-rich froth while other materials remain in the aqueous solution. This occurs because the asphaltenes and target minerals, either naturally or by action of a collector reagent, are hydrophobic. The minerals that remain in the aqueous solution are those minerals that, either naturally or by action of a depressant, are hydrophilic. In addition to asphaltenes and target minerals, the asphaltene-rich froth may include naturally floatable minerals, minerals entrained in the asphaltenes and residual solvent. After the flotation process, the remaining aqueous phase can be routed to recycle for heat and water recovery or disposal and the asphaltene-rich froth can be routed to further processing.

After flotation to separate asphaltenes and/or target minerals from other materials in the asphaltene-containing tailings, the resulting asphaltene-rich froth can be thickened, such as by the removal of at least a portion of the contained gas phase. The thickening process also can include the removal of at least a portion of the water. Thickening can be performed, for example, using a dewatering cyclone or a conventional dewatering, clarifying, thickening and/or filtration process resulting in a clarified water overflow and an underflow. Excess water can be recovered with the overflow. The underflow can take the form of an asphaltene-rich slurry or an asphaltene-rich filter cake, which can be routed to further processing.

Some disclosed embodiments include one or more gravity separation processes. Gravity separation can be used, for example, to separate the asphaltene-rich froth or the asphaltene-rich slurry into a light tailings and a heavy mineral concentrate. If the gravity separation follows another separation step, such as a flotation separation, the heavy mineral concentrate may include a high percentage of the minerals targeted for recovery as well as unwanted minerals to be rejected. Reagents can be added to enhance the separation of the two phases. Attrition scrubbing also can be used to clean the mineral surfaces thereby enhancing the separation. Useful reagents for use in connection with a gravity separation process for separating the asphaltene-rich froth or the asphaltene-rich slurry into the light tailings and the heavy mineral concentrate include, for example, dispersants, surfactants and solvents. These reagents facilitate the separation, for example, by surface charge alteration and dispersion. In some embodiments, the dispersant comprises a silicate, a phosphate, a citrate, a lignin sulfonate, or a combination or derivative thereof. Flotation and gravity separation can be combined into one process step, such as an air-sparged hydrocyclone flotation step (as shown, for example, in U.S. Pat. No. 4,838,434, which is incorporated herein by reference).

To recover an asphaltene concentrate, some embodiments include a hydrophobic agglomeration separation, which also may be referred to as a hydrophobic flocculation separation, an oil agglomeration separation or an oil flocculation separation. One example of such as separation is shown in U.S. Pat. No. 5,162,050, which is incorporated herein by reference. This separation can be performed, for example, on the light tailings that exit the gravity separation, on the asphaltene-rich froth that exits the flotation separation or on the asphaltene-rich slurry that exits the thickening step. Hydrophobic agglomeration generally involves the use of a hydrophobic agglomeration agent that flocculates small particles of the material to be separated into larger flocs. The selectivity arises from differences in the surface properties of the materials in the solution, particularly differences in hydrophobicity. Typically, the hydrophobic agglomeration agent is introduced into the solution and then is dispersed to form droplets. The hydrophobic agglomeration agent also can be introduced and dispersed simultaneously. The droplets agglomerate with some materials and leave other materials in the solution. Dispersing the hydrophobic agglomeration agent to form droplets can be accomplished, for example, by agitating the solution or spraying the hydrophobic agglomeration agent through a nozzle. Once agglomeration has occurred, the large flocs including the material to be separated can be removed from the solution, such as by settling or filtration.

Hydrophobic agglomeration is used in some disclosed embodiments to separate asphaltenes. For example, hydrophobic agglomeration can follow a flotation separation or a gravity separation. Hydrophobic agglomeration often is performed as a final separation before recovery of an asphaltene concentrate because it allows for the rapid separation of asphaltenes from water. Hydrophobic agglomeration also can have a high degree of selectivity, which allows for the recovery of a relatively pure asphaltene concentrate. After it is formed, the asphaltene concentrate can be upgraded into more valuable hydrocarbon products or burned, for example, as a feed stock for a gasifier. Any minerals in the remaining solution also can be recovered. In some embodiments, the remaining solution is combined with previously separated minerals, such as a heavy mineral concentrate that exits a gravity separation.

The hydrophobic agglomeration process can be configured to maximize the selective recovery of asphaltenes. For example, a hydrophobic agglomeration agent can be selected that selectively agglomerates with asphaltenes, while leaving other materials in the solution. In some embodiments, the hydrophobic agglomeration agent comprises diesel, a fuel oil, a surfactant, or a combination or derivative thereof. The hydrophobic agglomeration agent can be introduced at a concentration selected to separate asphaltenes from other components in the solution. For example, the hydrophobic agglomeration agent can be introduced at a concentration between about 5,000 ppm and about 15,000 ppm, such as between about 10,000 ppm and about 12,000 ppm.

Hydrophobic agglomeration is facilitated in some embodiments by the addition of one or more oxidizing agents, such as oxygen, or a chemical oxidizing agent, such as a peroxide, a hydroxide, a permanganate, Fenton's reagent, or a combination or derivative thereof. The oxidizing agent, if used, can be added in an amount that facilitates the desired result, such as an amount ranging from about 3,500 ppm to about 10,000 ppm or an amount ranging from about 5,000 ppm to about 7,500 ppm. Oxidizing agents can be used, for example, to oxidize the surfaces of minerals to be separated from the asphaltenes. This may improve selectivity by reducing or substantially eliminating hydrophobic compounds attached to these surfaces. For example, in some embodiments, oxidation is used to convert and substantially eliminate residual collector reagent adhered to the minerals during a previous flotation separation. Oxidation also may be useful to eliminate hydrophobic materials that naturally adhere to the surfaces of certain minerals, such as pyrite. Other reagents that may be used in connection with the hydrophobic agglomeration separation include dispersant reagents, modifying reagents, and causticizing agents. Examples of potentially useful causticizing agents include sodium hydroxide, potassium hydroxide, quicklime and combinations thereof.

In addition to separations directed to the recovery of asphaltenes, some embodiments include separations directed to the recovery of certain materials, such as lignite-type materials, sulfur-containing minerals and/or oxygen-containing minerals, particularly sulfide minerals and/or oxide minerals. In embodiments in which solvent exits the TSRU with the asphaltenes, it may be useful to perform at least some mineral recovery upstream from the TSRU. This can be useful, for example, to retain a combined solvent/asphaltene stream with minimum inorganic compounds. In some embodiments, a heavy mineral concentrate is separated from the asphaltene-containing tailings, such as by gravity separation, and subjected to further processing. Further processing can begin with an attritioning step, which can include shear attritioning, scrubbing or cycloning. Attritioning, like oxidation, can be useful to clean the mineral surfaces, such as to remove residual collector reagent adhered to the minerals during a previous flotation separation. The attritioning can involve subjecting the minerals to a high shear environment either in an attrition scrubber or attrition mill where the surfaces can rub together in an autogenous cleaning action.

Some embodiments include one or more steps for separating sulfur-containing minerals from other minerals to be recovered. Although they typically have little or no commercial value, sulfur-containing minerals can be separated with other target minerals to prevent their inclusion in tailings exiting the overall process. This reduces the environmental impact of tailings disposal because sulfur-containing minerals (e.g., pyrite, marcasite, etc.) tend to oxidize when stored in a tailings pond. The separation of sulfur-containing minerals from other minerals, particularly oxygen-containing minerals, can be accomplished, for example, by flotation. Frother and collector reagents can be used to facilitate the separation. Useful frother reagents include, for example, aliphatic alcohols, cyclic alcohols, phenols, alkoxy paraffins, polyglycols, and combinations and derivatives thereof. In some embodiments, the frother reagents have a polar group, such as a hydroxyl, a carboxyl, a carbonyl, an amino or a sulfo polar group, or a combination thereof. The frother reagents can be introduced at a concentration selected to promote the formation of stable bubbles that attract sulfur-containing minerals. For example, the frother reagents can be introduced at a concentration between about 5 ppm and about 100 ppm, such as between about 10 ppm and about 25 ppm. Useful collector reagents include fuel oils, sodium oleate, fatty acids, xanthates, alkyl sulfuric salts, dithiophosphates, amines or combinations or derivatives thereof. The collector reagents can be anionic or cationic. The collector reagents can be introduced at a concentration selected to increase the hydrophobicity of the sulfur-containing minerals. For example, the collector reagents can be introduced at a concentration between about 5 ppm and about 100 ppm, such as between about 25 ppm and about 50 ppm.

The introduction of gas bubbles, such as air bubbles, then can result in the formation of a sulfur-rich froth over a sulfur-depleted aqueous phase. Solid sulfur-containing minerals can be recovered from the sulfur-rich forth and stockpiled as a solid waste product or subjected to further processing to create a saleable product. The sulfur-depleted aqueous phase can have a high concentration of the minerals targeted for recovery. These minerals can include, for example, oxygen-containing minerals, such as Group 4B metal oxides, particularly titania, ilmenite and zirconia, which have significant value. The recovered minerals can be sold as commodities or upgraded by further purification and/or chemical modification. Recovered titania, for example, can be used to produce a pigment (as shown, for example, in U.S. Pat. No. 6,375,923, which is incorporated herein by reference).

Embodiments of the disclosed method and system can be used to recover energy as well as asphaltenes, solvent and minerals. Asphaltene-containing tailings often have excess heat energy relative to the ambient environment because solvent recovery in processes for recovering hydrocarbons from oil sand typically includes steam stripping. In some disclosed embodiments, aqueous tailings streams are produced by several different separation steps. Heat can be recovered from each of these aqueous tailings streams. The aqueous tailings streams also can be consolidated and subjected to a unified energy recovery process. For example, the consolidated tailings can be passed though a single heat exchanger. The heat exchanger can be used, for example, to heat water in the TSRU prior to its conversion into steam.

In addition to the primary unit operations, such as the unit operations described above, embodiments of the disclosed method and system can include secondary unit operations, such as pumps, plenums and regulators.

Some embodiments of the disclosed method and system for recovering energy and/or materials from asphaltene-containing tailings are described with reference to the figures in the following subsections.

Asphaltene-Containing Tailings

Figure 2:
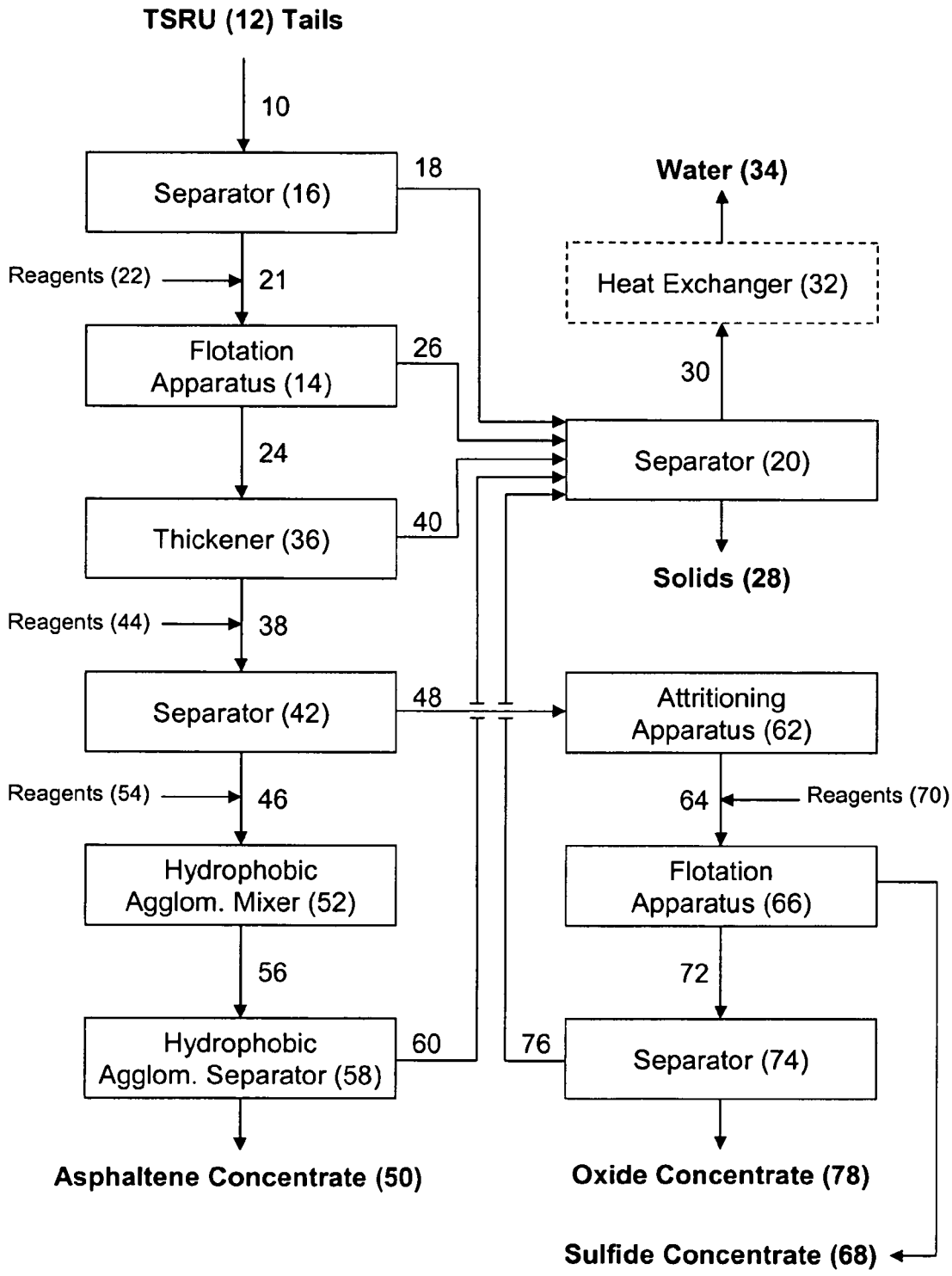
FIG. 2 is a schematic diagram representing embodiments of a method and a system for recovering energy, materials or both from asphaltene-containing tailings including a separation before flotation of the asphaltene-containing tailings.

In some disclosed embodiments, asphaltene-containing tailings 10 originate in a TSRU 12 unit operation. The asphaltene-containing tailings 10 that exit the TSRU 12 can be routed directly into a flotation apparatus 14, as shown in FIG. 1. Alternatively, as shown in FIG. 2, the asphaltene-containing tailings 10 can be routed through a separator 16, such as a cyclone separator, before entering the flotation apparatus 14. The separator 16 can be useful, for example, to separate coarse or heavy materials from the asphaltene-containing tailings 10 before the asphaltene-containing tailings 10 enter the flotation apparatus 14. The underflow 18 containing the coarse or heavy materials can exit the separator 16 and be routed to a separator 20, which is described in greater detail below. The overflow 21 can be routed to the flotation apparatus 14.

The flotation apparatus 14 can be used to separate asphaltenes and target minerals from other materials in the asphaltene-containing tailings 10. The floatation apparatus 14 can include a single floatation cell or multiple flotation cells, such as staged flotation cells configured as roughing, cleaning and/or scavenging cells. Reagents, indicated as 22 in FIGS. 1 and 2, can be added prior to or during the flotation process to facilitate the process as desired. The reagents 22 can include, for example, a frother reagent, a collector reagent, a modifier, or a combination thereof. In some embodiments, the reagents 22 include sodium hydroxide, a fuel oil, a glycol frother, or a combination or derivative thereof.

The flotation process within the flotation apparatus 14 can include introducing gas into the asphaltene-containing tailings 10. The flotation apparatus 14 can, for example, include a conventional agitated tank cell or a gas or mechanically stirred column cell. The solution can be mechanically agitated to promote the formation of bubbles of the gas and to promote interaction between the bubbles and the asphaltenes and/or the target minerals. In some embodiments, agitation is created by a mechanically-driven member located near the bottom of a vessel. The gas bubbles can be introduced via a gas conduit between a pressurized source and one or more openings within the vessel. In some embodiments, the gas is introduced near the mechanically-driven member so that the strong agitation readily distributes the bubbles throughout the asphaltene-containing tailings 10. The gas bubbles also can be introduced through a nozzle or though a perforated conduit. Typically, the gas is air, although in some embodiments it can be an inert gas such as nitrogen.

During the flotation process within the flotation apparatus 14, the asphaltenes and/or the target minerals in the asphaltene-containing tailings 10 rise with the gas bubbles to form an asphaltene-rich froth 24 over an asphaltene-depleted aqueous phase 26. The asphaltene-depleted aqueous phase 26, which typically includes water and non-floatable minerals, can be routed to the separator 20, where it can be separated into solids 28 and water 30. The separator 20 can be any separator capable of separating solids from water. In some embodiments, the separator 20 is a cyclone or a thickener.

The solids 28 exiting the separator 20 can include minerals that were not targeted for removal with the asphaltenes during the flotation process within the flotation apparatus 14. In some embodiments, the solids 28 mainly comprising inorganic materials (e.g., silica sand), are disposed of as a waste material. To reduce the adverse environmental impact associated with disposal of the solids 28, some disclosed embodiments include the separate removal of potentially harmful materials from the asphaltene-containing tailings 10. For example, in some embodiments, sulfur-containing minerals, which can be damaging to the environment, are targeted for separation during the flotation process within the flotation apparatus 14 so as to minimize their concentration in the solids 28. The sulfur-containing minerals can be targeted, for example, by using a collector reagent that increases the hydrophobicity of the sulfur-containing minerals. By removing sulfur-containing minerals with the asphaltene-rich froth 24 exiting the flotation apparatus 14, the concentration of sulfur-containing minerals in the solids 28 can be reduced, for example, to between about 0.05% and about 0.8%, such as between about 0.1% and about 0.5% or between about 0.2% and about 0.3%.

If the asphaltene-containing tailings 10 exit the TSRU 12 at an elevated temperature, the water 30 exiting the separator 20 is likely to contain excess heat energy relative to the ambient environment. In some embodiments, the water 30 is routed back to the TSRU 12 to be converted into steam or to an alternative part of the process for reuse. The water 30 also optionally can be routed through a heat exchanger 32. Heat from the heat exchanger 32 can be used, for example, to partially heat water before it is converted into steam for use in the TSRU 12. The water 34 that exits the heat exchanger 32 can be recycled for use in other unit operations of the oil sand recovery processes.

After exiting the flotation apparatus 14, the asphaltene-rich froth 24 can be routed to a thickener 36. The thickener 36 can be configured to thicken the asphaltene-rich froth 24 into an asphaltene-rich thickener underflow slurry 38. The thickener 36 can operate, for example, by removing gas and water from the asphaltene-rich froth 24. Removed water 40 can be routed to the separator 20 to be separated and recycled with the asphaltene-depleted aqueous phase 26. The asphaltene-rich thickener underflow slurry 38 can be routed to a separator 42, such as a gravity separator, for further processing.

The separator 42 can be used to separate the minerals removed with the asphaltene-rich froth 24 from the asphaltenes. These minerals can include minerals of value to be recovered during later processing and minerals removed to avoid their inclusion in the solids 28. Separation at this separation stage is exemplified by gravity separation. Gravity separation can be accomplished using several different techniques. In some embodiments, the separator 42 is a shaking table. Shaking tables typically provide agitation that causes lighter materials to move greater distances than heavier materials. Ridges can be included on the surface of the table to further inhibit movement of the heavier materials while allowing movement of the lighter materials. Other suitable types of gravity separators include hydrocyclones, spiral concentrators, fluidized bed hydrosizers and centrifugal concentrators. Reagents, indicated as 44 in FIGS. 1 and 2, can be added to facilitate the separation.

The asphaltene-rich thickener underflow slurry 38, after exiting the separator 42, can be separated into a light tailings 46 and a heavy mineral concentrate 48. These streams can be subjected to further processing.

Light Tailings

The light tailings 46 that exit the separator 42 can be processed to recover an asphaltene concentrate 50. In some disclosed embodiments, hydrophobic agglomeration is used to recover the asphaltene concentrate 50. For example, the light tailings 46 can be routed into a hydrophobic agglomeration mixer 52. Reagents 54 can be added, including a hydrophobic agglomeration agent. The light tailings 46 and the hydrophobic agglomeration agent can be mixed in the hydrophobic agglomeration mixer 52 to disperse the hydrophobic agglomeration agent into droplets. These droplets then can agglomerate with the asphaltenes in the light tailings 46 to form asphaltene-containing particles. In addition to the hydrophobic agglomeration agent, the reagents 54 can include an oxidizing agent and/or a causticizing agent.

In some disclosed embodiments, the resulting mixture 56, including the asphaltene-containing particles, is routed from the hydrophobic agglomeration mixer 52 to a hydrophobic agglomeration separator 58. In other embodiments, mixing and separating occur in the same device. Within the hydrophobic agglomeration separator 58, the asphaltene-containing particles can be separated from a remainder 60, such as by settling or filtration. Filtration can be performed, for example, using a mesh with an average pore size between about 150 μm and about 750 μm, such as between about 250 μm and about 500 μm or between about 275 μm and about 325 μm. The remainder 60, which can include water and any remaining mineral solids, can be routed to the separator 20 for recycling or disposal.

Some embodiments of the disclosed method yield an asphaltene concentrate 50 with a relatively high degree of purity. For example, in some embodiments, the asphaltene concentrate 50 includes between about 60% and about 95% asphaltenes, such as between about 70% and about 90% or between about 80% and about 90%. After recovery, the asphaltene concentrate 50 can be sold as a commodity, such as a fuel, or subjected to further processing, such as to upgrade the asphaltene concentrate 50 into oil or into gas through a gasification process.

Heavy Mineral Concentrate

The heavy mineral concentrate 48 that exits the separator 42 can be routed to an attritioning apparatus 62. The attritioning process within the attritioning apparatus 62 can include grinding the heavy mineral concentrate 48 to disperse aggregates and remove any coatings that may interfere with subsequent processing. The attritioning apparatus 62 can be, for example, a high shear mixer, attrition scrubber or an attrition grinding mill.

After exiting the attritioning apparatus 62, the attritioned minerals 64 can be routed to a flotation apparatus 66 for separation. The flotation apparatus 66 can be used, for example, to separate a sulfur-containing mineral concentrate 68 from the attritioned minerals 64. Separating sulfur-containing minerals in a concentrated form can be useful to reduce the environmental impact of the waste materials created by the overall process. The flotation apparatus 66 can be configured for the separation of sulfur-containing minerals, for example, by selection of reagents 70. The floatation apparatus 66 can include a single floatation cell or multiple flotation cells, such as staged flotation cells configured as roughing, cleaning and/or scavenging cells. As with the reagents 22 used with the flotation apparatus 14, the reagents 70 can include, for example, a frother reagent and/or a collector reagent. In addition to frother reagents and collector reagents, the reagents 70 can include modifiers, such as dispersants, regulators, and activators.

The sulfur-containing mineral concentrate 68 can exit the flotation apparatus 66 with the froth. In some embodiments, the froth is thickened and any remaining water is removed to solidify the sulfur-containing mineral concentrate 68. Any asphaltenes removed from the sulfur-containing mineral concentrate 68 can mixed with the light tailings 46 described above. After separation of the sulfur-containing mineral concentrate 68, the remaining sulfur-depleted aqueous phase 72 can include the minerals targeted for recovery, such as commercially valuable minerals included in the oil sand from which the asphaltene-containing tailings 10 were derived. These minerals can include, for example, oxygen-containing minerals, such as Group 4B metal oxides, particularly titania, ilmenite and zirconia. In some embodiments, the sulfur-depleted aqueous phase 72 is routed to a separator 74 after exiting the flotation apparatus 66. Within the separator 74, a remainder 76 can be separated, leaving an oxygen-containing mineral concentrate 78. The remainder 76, which includes mostly water, can be routed to the separator 20 for recycling or disposal.

The oxygen-containing mineral concentrate 78 can be sold as a commodity or subjected to further processing. Further processing can include refining into specific mineral types (e.g., ilmenite, leucoxene, anatase, rutile and zirconia). This can be done, for example, using conventional magnetic and electrostatic separations. These and other separation processes can be used to produce various grades of product, including ultra pure commercial grade concentrates. In some disclosed embodiments, an ilmenite mineral concentrate or other titania-containing mineral concentrate from the oxygen-containing mineral concentrate 78 is upgraded into pigment.

EXAMPLES

The following examples are provided to illustrate certain particular embodiments of the disclosure. Additional embodiments not limited to the particular features described are consistent with the following examples.

Example 1

An initial flotation separation on TSRU tailings was carried out in a 3 meter long column flotation cell. The flotation was conducted at a temperature of 70 to 75° C. A glycol ester frother reagent was added at a concentration of 25 grams per ton of solids. After optimization of the flotation conditions, a high grade concentrate (froth) containing the asphaltenes and heavy minerals was produced. The silicate and clay non-targeted minerals were rejected to a tailings product. The grades of various minerals in the concentrate, tailings and feed streams are shown in Table 1, along with the percent recovery of the minerals in the concentrate and tailings. As shown in Table 1, the mass reject to tailings was 33.5% of the total feed. Recoveries of the targeted asphaltenes and heavy minerals were high. In laboratory tests, the tailings from the flotation were successfully thickened using a commercial polymeric flocculant. Clean, hot supernatant water was recovered from the flocculated tailings. This illustrates one example of heat and energy recovery.

TABLE 1

| | Data for Froth Flotation Separation of TSRU Tailings | | | | | | | | |
|---|---|---|---|---|---|---|---|---|---|
| | Wt % | $Al_2O_3$ | $SiO_2$ | $TiO_2$ | $ZrO_2$ | Fe | S | C | LOI* |
| | | | Grade—% | | | | | | |
| Concentrate | 66.5 | 6.7 | 15.5 | 6.9 | 1.9 | 3.8 | 5.7 | 40.9 | 59.9 |
| Tailing | 33.5 | 12.5 | 73.6 | 1.4 | 0.08 | 1.3 | 0.4 | 2.6 | 8.4 |
| Feed | 100 | 8.6 | 35.0 | 5.0 | 1.3 | 3.0 | 3.9 | 28.1 | 42.6 |
| | | | Recovery—% | | | | | | |
| Concentrate | 66.5 | 51.5 | 29.4 | 91.0 | 98.0 | 85.6 | 97.0 | 96.8 | 93.4 |
| Tailing | 33.5 | 48.5 | 70.6 | 9.0 | 2.0 | 14.4 | 3.0 | 3.2 | 6.6 |

*= Loss on ignition

Example 2

The froth flotation concentrate from Example 1 was subjected to gravity separation to obtain an asphaltene rich phase and a heavy or oxide mineral rich phase. Table 2 shows the experimental data for a single stage gravity separation process. The results can be further improved upon by using a series of gravity separators with roughing, cleaning and scavenging duties.

TABLE 2

Data for First Stage Gravity Separation of Froth Flotation Concentrate

| | Wt % | $Al_2O_3$ | $SiO_2$ | $TiO_2$ | $ZrO_2$ | Fe | S | C | LOI |
|---|---|---|---|---|---|---|---|---|---|
| | | | Grade—% | | | | | | |
| Heavy Concentrate | 20.2 | 6.6 | 22.0 | 22.6 | 6.5 | 6.5 | 4.6 | 20.7 | 29.7 |
| Asphaltene Lights | 79.8 | 5.8 | 13.0 | 3.6 | 0.5 | 3.4 | 5.9 | 51.5 | 71.8 |
| Feed | 100.0 | 6.0 | 14.8 | 7.5 | 1.7 | 4.0 | 5.6 | 45.2 | 63.3 |
| | | | Recovery—% | | | | | | |
| Heavy Concentrate | 20.2 | 22.4 | 30.0 | 61.1 | 75.2 | 32.5 | 16.6 | 9.3 | 9.5 |
| Asphaltene Lights | 79.8 | 77.6 | 70.0 | 38.9 | 24.8 | 67.5 | 83.4 | 90.7 | 90.5 |

Example 3

The heavy mineral concentrate from Example 2 was subjected to further cleaning using a de-oiling step. This step included conditioning the heavy mineral concentrate in sodium hydroxide and hydrogen peroxide to clean the particle surfaces and prevent the particles from floating. A further flotation step was then used to reduce the asphaltene content and to separate the sulfide minerals. The sulfide minerals were activated with copper sulfate. A xanthate-type bulk flotation collector also was added. After the flotation, the resultant froth contained the sulfide minerals and residual hydrocarbons. This left a cleaner heavy mineral product as a flotation tailing. The grades of various minerals in the asphaltene/sulfide concentrate, heavy mineral product and feed streams are shown in Table 3 along with the percent recovery of the minerals in the asphaltene/sulfide concentrate and heavy mineral product.

TABLE 3

Data for Froth Flotation Separation of Heavy Mineral Concentrate

| | Wt % | $Al_2O_3$ | $SiO_2$ | $TiO_2$ | $ZrO_2$ | Fe | S | C | LOI |
|---|---|---|---|---|---|---|---|---|---|
| | | | Grade % | | | | | | |
| Asphaltene/ Sulfide Concentrate | 39.8 | 1.3 | 6.6 | 6.3 | 2.7 | 12.9 | 11.3 | 46.7 | 65.8 |
| Heavy Mineral Product | 60.1 | 10.1 | 32.2 | 33.4 | 9.0 | 2.3 | 0.2 | 3.5 | 5.8 |
| Feed | 100 | 6.6 | 22 | 22.6 | 6.5 | 6.5 | 4.6 | 20.7 | 29.7 |
| | | | Recovery % | | | | | | |
| Asphaltene/ Sulfide Concentrate | 39.9 | 7.8 | 11.9 | 11.1 | 16.5 | 79.0 | 97.8 | 89.8 | 88.2 |
| Heavy Mineral Product | 60.1 | 92.0 | 88.0 | 88.8 | 83.2 | 21.3 | 2.6 | 10.2 | 11.7 |

Example 4

The asphaltene lights from Example 2 were treated by oil agglomeration. The results of this process are shown in Table 4. The oil agglomeration process included treating the wet asphaltene concentrate with a caustic additive. The resultant slurry then was subjected to ultrasonic conditioning for 30 minutes and mixed with diesel in a high-speed mixer for 10 minutes. The resultant pulp then was screened with a 50 mesh (300 μm). Slime passed through the mesh while the agglomerated asphaltenes were captured on the mesh. The agglomerated asphaltene was re-pulped with the high-speed mixer and re-screened to reject additional slime. The asphaltene product was found to contain 15% inorganic solids with in excess of 95% carbon recovery to the asphaltene concentrate. About 70% $Al_2O_3$, 76% $SiO_2$ and 36% S was rejected. The asphaltene concentrate had a carbon content of about 63% and a loss on ignition of about 86%. The heating value was about 12,000 Btu per pound. The asphaltene concentrate also was found to contain residual hydrocarbon solvent that could be recovered during further processing and converted to lower chain hydrocarbons. The asphaltene concentrate provides a ready fuel source for energy or heat generation in oil sand processing.

TABLE 4

| | Oil Agglomeration of Asphaltenes | | | | | | | | |
|---|---|---|---|---|---|---|---|---|---|
| | Wt % | $Al_2O_3$ | $SiO_2$ | $TiO_2$ | $ZrO_2$ | Fe | S | C | LOI |
| | | | Grade (%) | | | | | | |
| Asphaltene | 71.6 | 2.3 | 5.4 | 2.2 | 0.5 | 3.2 | 5.0 | 63.1 | 86 |
| Slime I | 21.4 | 16.3 | 52.4 | 2.8 | 0.1 | 2.4 | 8.9 | 5.2 | 24 |
| Slime II | 7.0 | 4.7 | 15.5 | 3.2 | 0.4 | 3.4 | 1.1 | 13.5 | 70 |
| Feed | 100 | 5.5 | 16.2 | 2.4 | 0.4 | 3.0 | 5.6 | 47.2 | 71.6 |
| | | | Distribution (%) | | | | | | |
| Asphaltene | 71.59 | 30.1 | 23.9 | 65.7 | 87.9 | 75.3 | 64.4 | 95.6 | 86.0 |
| Slime I | 21.43 | 63.8 | 69.4 | 25.0 | 5.3 | 16.9 | 34.2 | 2.4 | 7.2 |
| Slime II | 6.98 | 6.0 | 6.7 | 9.3 | 6.9 | 7.8 | 1.4 | 2.0 | 6.8 |

In view of the many possible embodiments to which the principles of the disclosed invention may be applied, it should be recognized that the illustrated embodiments are only examples of the invention and should not be taken as limiting the scope of the invention. Rather, the scope of the invention is defined by the following claims. We therefore claim as our invention all that comes within the scope and spirit of these claims.

We claim:

1. A method, comprising:

introducing gas into asphaltene-containing tailings such that asphaltenes in the asphaltene-containing tailings rise with bubbles of the gas to form an asphaltene-rich froth over an asphaltene-depleted aqueous phase comprising water and non-floatable minerals;

separating the asphaltene-rich froth, or an asphaltene-rich slurry formed from the asphaltene-rich froth, into a heavy mineral concentrate and a light tailings comprising water and asphaltenes;

dispersing a hydrophobic agglomeration agent within the light tailings to form droplets, wherein the droplets agglomerate with the asphaltenes to form asphaltene-containing particles; and separating the asphaltene-containing particles from the light tailings as an asphaltene concentrate.

2. The method according to claim 1, wherein the asphaltene-containing tailings comprise tailings from a process for recovering hydrocarbons from oil sand.

3. The method according to claim 1, further comprising recovering heat energy from the asphaltene-depleted aqueous phase.

4. The method according to claim 1, wherein separating the asphaltene-containing particles from the light tailings comprises separating the asphaltene-containing particles from the light tailings by gravity separation.

5. The method according to claim 1, wherein separating the asphaltene-containing particles from the light tailings comprises separating the asphaltene-containing particles from the light tailings by filtration.

6. The method according to claim 1, wherein the heavy mineral concentrate comprises titania, ilmenite, zirconia, or a combination thereof.

7. The method according to claim 1, wherein the hydrophobic agglomeration agent comprises diesel, a fuel oil, a surfactant, or a combination or derivative thereof.

8. The method according to claim 1, further comprising introducing a frother reagent comprising an aliphatic alcohol, a cyclic alcohol, a phenol, an alkoxy paraffin, a polyglycol, or a combination or derivative thereof, into the asphaltene-containing tailings before or while introducing gas into the asphaltene-containing tailings.

9. The method according to claim 1, further comprising introducing a collector reagent comprising a fuel oil, sodium oleate, a fatty acid, a xanthate, an alkyl sulfuric salt, a dithiophosphate, an amine, or a combination or derivative thereof, into the asphaltene-containing tailings before or while introducing gas into the asphaltene-containing tailings.

10. The method according to claim 1, further comprising introducing a dispersant reagent comprising a silicate, a phosphate, a citrate, a lignin sulfonate, or a combination or derivative thereof, into the asphaltene-rich froth or the asphaltene-rich slurry before or while separating the asphaltene-rich froth or the asphaltene-rich slurry into a heavy mineral concentrate and a light tailings.

11. The method according to claim 1, further comprising introducing an oxidizing agent into the light tailings before or while dispersing the hydrophobic agglomeration agent.

12. The method according to claim 1, further comprising introducing a causticizing agent into the light tailings before or while dispersing the hydrophobic agglomeration agent.

13. The method according to claim 1, further comprising introducing an oxidizing agent and a causticizing agent or a mixture thereof into the light tailings before or while dispersing the hydrophobic agglomeration agent.

14. The method according to claim 1, further comprising removing water from the asphaltene-rich froth or the asphaltene-rich slurry, and further comprising recovering heat energy from the water removed from the asphaltene-rich froth or the asphaltene-rich slurry.

15. The method according to claim 1, further comprising separating coarse minerals from the asphaltene-containing tailings before introducing gas into the asphaltene-containing tailings.

16. The method according to claim 15, wherein separating coarse minerals from the asphaltene-containing tailings comprises subjecting the asphaltene-containing tailings to a cyclone separation process, and the coarse minerals are removed with an underflow from the cyclone separation process.

17. The method according to claim 16, wherein the cyclone separation process is a gas-sparged hydrocyclone separation process.

18. The method according to claim 1, further comprising separating sulfur-containing minerals from the heavy mineral concentrate.

19. The method according to claim 18, further comprising attritioning the heavy mineral concentrate before separating the sulfur-containing minerals from the heavy mineral concentrate.

20. The method according to claim 19, wherein attritioning the heavy mineral concentrate comprises attritioning to clean the mineral surfaces.

21. The method according to claim 18, wherein separating the sulfur-containing minerals from the heavy mineral concentrate comprises:

introducing gas into the heavy mineral concentrate such that the sulfur-containing minerals rise with bubbles of the gas to form a sulfur-rich froth over a sulfur-depleted aqueous phase comprising water and oxygen-containing minerals; and recovering the oxygen-containing minerals from the sulfur-depleted aqueous phase.

22. The method according to claim 21, further comprising recovering the sulfur-containing minerals from the sulfur-rich froth or a sulfur-rich slurry formed from the sulfur-rich froth.

23. The method according to claim 21, wherein the oxygen-containing minerals comprise titania, ilmenite, zirconia, or a combination thereof.

24. The method according to claim 21, further comprising introducing a frother reagent comprising an aliphatic alcohol, a cyclic alcohol, a phenol, an alkoxy paraffin, a polyglycol, or a combination or derivative thereof, into the heavy mineral concentrate before or while introducing gas into the heavy mineral concentrate.

25. The method according to claim 21, further comprising introducing a collector reagent comprising a fuel oil, sodium oleate, a fatty acid, a xanthate, a alkyl sulfuric salt, a dithiophosphate, an amine, or a combination or derivative thereof, into the heavy mineral concentrate before or while introducing gas into the heavy mineral concentrate.

26. The method according to claim 1, further separating a lignite concentrate from the asphaltene-rich froth or an asphaltene-rich slurry formed from the asphaltene-rich forth.

27. The method according to claim 26, wherein separating the lignite concentrate comprises performing a screening process, a gravity separation process, a solvent extraction process or a combination thereof.

28. A method for recovering energy, materials or both from asphaltene-containing tailings, comprising:

introducing a hydrophobic agglomeration agent into tailings comprising water, asphaltenes and inorganic minerals;

dispersing the hydrophobic agglomeration agent to form droplets, wherein the droplets agglomerate with the asphaltenes to form asphaltene-containing particles; and separating the asphaltene-containing particles from the tailings as an asphaltene concentrate.

29. The method according to claim 28, wherein the asphaltene-containing tailings comprise tailings from a process for recovering hydrocarbons from oil sand.

30. The method according to claim 28, wherein the hydrophobic agglomeration agent comprises diesel, a fuel oil, a surfactant, or a combination or derivative thereof.

* * * * *

UNITED STATES PATENT AND TRADEMARK OFFICE

CERTIFICATE OF CORRECTION

PATENT NO. : 7,585,407 B2
APPLICATION NO. : 11/371327
DATED : September 8, 2009
INVENTOR(S) : Duyvesteyn et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 831 days.

Signed and Sealed this

Fourteenth Day of September, 2010

David J. Kappos

David J. Kappos
*Director of the United States Patent and Trademark Office*